US009108763B2

(12) United States Patent
Landau

(10) Patent No.: US 9,108,763 B2
(45) Date of Patent: Aug. 18, 2015

(54) SYSTEM AND METHOD FOR APPLYING AROMA RELEASING MATERIAL TO PRODUCT PACKAGING

(76) Inventor: Steven Marc Landau, Jenkintown, PA (US)

( * ) Notice: Subject to any disclaimer, the term of this patent is extended or adjusted under 35 U.S.C. 154(b) by 709 days.

(21) Appl. No.: 13/287,122

(22) Filed: Nov. 1, 2011

(65) Prior Publication Data

US 2013/0105066 A1 May 2, 2013

(51) Int. Cl.

| | |
|---|---|
| ***B65D 1/02*** | (2006.01) |
| ***B65D 1/26*** | (2006.01) |
| ***B65D 23/00*** | (2006.01) |
| ***B65D 25/00*** | (2006.01) |
| ***B65D 33/00*** | (2006.01) |
| ***B65D 81/34*** | (2006.01) |
| ***B65D 51/24*** | (2006.01) |
| ***B05D 1/00*** | (2006.01) |

(52) U.S. Cl.

CPC *B65D 23/00* (2013.01); *B05D 1/62* (2013.01); *B65D 1/02* (2013.01); *B65D 1/265* (2013.01); *B65D 25/00* (2013.01); *B65D 33/00* (2013.01); *B65D 51/245* (2013.01); *B65D 81/3453* (2013.01); *B65D 2203/12* (2013.01)

(58) Field of Classification Search

CPC ..... B05D 1/62; B05D 1/00; B05D 1/02; B05D 1/265; B05D 2203/12

USPC ..... 427/488

See application file for complete search history.

(56) References Cited

U.S. PATENT DOCUMENTS

| | | | | |
|---|---|---|---|---|
| 5,446,070 | A * | 8/1995 | Mantelle | 514/772.6 |
| 6,045,833 | A | 4/2000 | Landau | |
| 6,102,224 | A | 8/2000 | Sun et al. | |
| 6,705,575 | B1 * | 3/2004 | Hoy | 248/99 |
| 7,452,927 | B2 | 11/2008 | Hayes | |
| 2009/0095164 | A1 * | 4/2009 | Celeste | 99/285 |
| 2010/0055245 | A1 | 3/2010 | Havekotte et al. | |

* cited by examiner

*Primary Examiner* — James M Mellott

(74) *Attorney, Agent, or Firm* — LaMorte & Associates, P.C.

(57) ABSTRACT

A system for creating a microencapsulate coating composition and the method of adding the scented microencapsulate coating to product packaging. The microencapsulate coating contains scented compounds that are encapsulated to create encapsulated particles. The encapsulant can be either water soluble or hydrophobic depending upon the intended application. The encapsulated particles are mixed with a binding agent, to create a scented microencapsulate coating. The scented microencapsulate coating is applied to packaging in areas that will be touched as the packaging is manipulated. The physical contact ruptures the microencapsulate coating and releases the scented compounds contained therein.

8 Claims, 10 Drawing Sheets

SYSTEM AND METHOD FOR APPLYING AROMA RELEASING MATERIAL TO PRODUCT PACKAGING

BACKGROUND OF THE INVENTION

1. Field of the Invention

In general, the present invention relates to the systems and methods of applying an activated scent releasing material to a surface. More particularly, the present invention relates to the composition of the scent releasing material and its method of application to products and/or their packaging.

2. Prior Art Statement

There are many products on the market, many with their own distinct aroma. The aroma of a product can be a main driver in a consumer's purchase decision. For example, most people who purchase shampoo or other personal care products will first open the bottle in order to sample its aroma. As a result of that and other reasons, the concept of scent sampling has emerged on the market and brand owners are seeking ways to communicate their offer while keeping their products properly packaged and safe. When it comes to consumable products, the aroma is also a main driver in consumer liking or preference. Similarly, the makers of such products are always seeking ways to improve the consumer experience.

With respect to Scent Sampling, there are many situations where it is beneficial to enable consumers to be able to sample the aroma of a product prior to purchase. The ability to convey a product's aroma at shelf enables the utilization of scent as a purchase motivator. There are a number of scent sampling technologies which have been used on products to convey scent prior to purchase. One such innovation is pressure sensitive scratch and sniff stickers. These stickers are made with microencapsulated scent which mimics the scent of the products contents. Consumers are encouraged to scratch the sticker to sample the product scent prior to purchase. While this is an effective way to convey scent, the cost of printing a sticker with microencapsulates and then applying it to a product can be very expensive.

With respect to product enhancement, a products aroma can also be a key factor in the consumer's experience with the product prior to consumption. A product's aroma is especially related to the consumer's anticipated liking of a product. For example, if something smells good when opened it helps to predispose a person to like the product, even before consumption. As a result of this fact, brand owners and packaging manufactures have expended considerable R&D efforts to find ways to improve product aroma.

A number of technologies have been developed to help deliver aroma on a package. For example, ScentSational Technologies, LLC, has developed technologies that incorporate scent into the structure of plastic packaging components. Consider U.S. Pat. No. 6,045,833, entitled Receptacle Having Aromatic Properties And Method Of Use, which discloses the use of scented closures on a beverage container. Also, consider also U.S. Pat. No. 6,102,224 to Sun, et al entitled Modifying Flavor Experience via Aroma Delivery, which is assigned to PepsiCo and discloses a system whereby scented microencapsulates are applied to a bottle top's threading. When a person removes the closure, the encapsulates on the threading are ruptured and a desirable scent is released.

There are however issues with the approach of these types of innovations. Both of the aforementioned patents intentionally deliver aroma directly into the mouth during consumption. While in some cases this may be desirable, in other cases it is not. This current invention deals with a technology to deliver only orthonasal aroma, that is aroma that is only received through the nose.

The aforementioned Pepsi patent is not intended to deliver aroma prior to purchase or use. It is specifically intended to only deliver aroma upon activated release upon opening. However, a problem exists with this approach. During bottling, many of the scented microcapsules which are applied to the bottle neck are prematurely ruptured when the cap is torqued onto the bottle. As a result, some of those exposed aroma's or flavor oils will then oxidize and degrade potentially causing off notes upon opening and subsequent consumption. Additionally, as mentioned above, the Pepsi patent subjects the consumer to directly ingesting the scented compounds which are placed onto the container, in some cases this may not be desirable.

Inside the package or bottle there is another concern; the unwanted degradation of flavors and their interaction within the container. One of the issues is that during product processing and storage, aromas oxidize and degrade, often times causing off aromas which may be unappealing to consumers.

As a result, during the first opening of a beverage or food bottle or package, the initial aroma during opening can be very unappealing to consumers. This can ultimately result in setting up a poor expectation of the product about to be consumed and can negatively impact the overall liking of the product. Brand owners have experimented for years in adding aroma into the headspace of a container to improve consumer perception. However, there are inherent problems with this approach, the most relevant being that naked or unprotected aromas will often in time also degrade and can result in additional unappealing off notes.

To solve these problems, some manufacturers have considered adding scented material to product packaging that is encapsulated. Scented microencapsulated coatings help to keep flavors and fragrances fresh from oxidation and degradation. They are designed to only release scent when the microencapsulate material is physically altered to break open. At the point of activation, the microencapsulate releases the intended scent. One example of microencapsulated material is what is typically referred to as "scratch & sniff".

Such prior art is exemplified in the afore-mentioned U.S. Pat. No. 6,102,224 entitled Modifying Flavor Experience via Aroma Delivery.

Application Pub. No. 2010/0055245 to Havekotte, entitled Modifying Flavor Experience via Aroma Delivery, which is assigned to PepsiCo, addresses applying an aroma to a package. However there are many problems with just applying an aroma to a package. As stated above, an unprotected aroma will oxidize and degrade very quickly causing stale, unbalanced, and oxidized off notes. Further, the aroma oil might get on people's hands, cause stains and could even cause cross contamination issues. The end use and subsequent consumer experience could be very inconsistent over time. Last, the aroma would not stay on the package as intended as the package is exposed to different conditions from the manufacturing plant through consumption.

A need therefore exists for a method to deliver an improved product aroma without actually exposing that aroma to the product and which is activated only when intended. Additionally, the method should allow a consumer to sample the aroma of a product from the store shelf and/or have a desirable scent release prior to consumption, both without directly mixing or coming into contact with the actual product.

As illustrated above, one might consider traditional scratch and sniff technology as a way to deliver the intended consumer experience. However, there are issues with traditional scratch and sniff. For example, it was developed as a print technology for paper. Companies who have opted to deploy this type of technology normally use pressure sensitive labels which are printed with scented microcapsules and then adhered to the package. This has primarily been used as a scent sampling concept. There are several problems with this approach. One is that it is a very expensive process to print a scratch and sniff label and then to adhere it onto a package. Often times putting the sticker on the product costs far more than the sticker itself. Another problem is that when people scratch a paper product, the paper can actually wear away leaving the package looking as though it is damaged. Scratch and sniff stickers are also very noticeable and require one to scratch it so therefore cannot be deployed as a way to enhance the consumer experience without the consumer knowing from where the enhanced aroma originated. Therefore, although it potentially can deliver an improved aroma experience before consumption, people would attribute the improved aroma to the sticker and not to the product itself. This would therefore defeat the purpose. Thus, it is important to have a way to inexpensively apply a scented microencapsulate directly onto a plastic, metal, glass and other types of packaging, during the manufacturing process, make it invisible and also to strategically position the encapsulate so that it is activated during handling of the product.

It is important to point out that simply placing a microencapsulate on a package does not always work. Although this technique may work for some packaging materials such as porous uncoated paper, most packaging is made of plastics, paper coated with plastics, or other materials which do not allow the micoencapsulate to properly adhere to its surface. Additionally, bottles are made with crystalline structures which will not allow adhesion and some films and closures are made with slip agents and plasticizers. When applying microencapsulates to a plastic film, bottles or closures made with plasticizers or slip agents, the encapsulate may appear to stick at first, but will not permanently adhere to the surface. To counter this issue, the aforementioned Pepsi U.S. Pat. No. 6,102,224 discloses a method of pre-treating, coating or etching the surface of the bottle neck or closure in order for the microencapsulate to stick onto the package. However, in the case of the Pepsi patent, adhesion was not much of a concern as the microencapsulate coating was to be applied to the PET bottle neck just before capping. Microencapsulates applied to any smooth or plastic surface will flake or wipe off if not protected. In the case in the Pepsi patent, it is protected by the outer closure. It is important therefore to utilize a binder system to allow the microencapsulated coatings to adhere to the plastic substrate. Such binder systems are mentioned in by U.S. Pat. No. 7,452,927 to Hayes, entitled Alphatic-Aromatic Polyesters And Articles Made Therefrom.

It is important to note that although manufacturers may have tinkered with the concept of adding a microencapsulate coating onto a package, applying the microencapsulate coating on a commercial production line is entirely different from making lab samples.

The present invention addresses not only the method and use of scented microencapsulates on packaging, but also how to enable them to be applied on a high speed commercial production line. Consumer product manufacturing is typically done at very high speeds. It is not uncommon for products to be packaged at speeds of between 200 and 1000 units per minute. Since slowing down the production line is not an option, there is the need to apply scented microencapsulated coatings onto packaging at very high speeds and at low cost while not adversely impacting the manufacturing operation.

A need therefore exists for a system and method of adding scented microencapsulate coatings to the exterior of product packaging in a commercial manufacturing plant. The microencapsulated coating needs to be applied in such a method that it hits a targeted area, cures quickly, stays on the package and enables the intended aroma to be activated and released primarily when the product packaging is handled or opened. These needs are met by the present invention as described and claimed below.

SUMMARY OF THE INVENTION

The present invention is a system and method of creating a microencapsulate coating composition and the method of adding the scented microencapsulate coating to the exterior and in some cases interior of a product packaging on a commercial production line. The microencapsulate coating contains flavor or fragrance scented compounds that are encapsulated in an encapsulant cell wall to create encapsulated particles. The encapsulant cell wall can be either water soluble or hydrophobic depending upon the intended application. The encapsulated particles are mixed with a binding agent, to create an emulsion to enable adhesion to plastics and other common packaging materials.

A product package is provided. The product package has exterior areas that are typically touched by a person during handling of a product from within said product package. The emulsion is applied to one or more of the contact areas. The emulsion is then cured to create a scented microencapsulate coating.

The composition of the binding agent and the microencapsulate size depends greatly upon the type of product packaging being coated and the intended aroma release. The encapsulate size in the below applications would typically be between 5 and 50 microns but could be changed depending on the intended application. The encapsulate type and binding agent can be type 1 for packaging that will be exposed to moisture. The type and binding agent can be type 2 for packaging that will not be exposed to moisture. The encapsulate type and binding agent can be type 3 for packaging that will be exposed to heat. Lastly, the encapsulate type and binding agent can be type 4 for packaging that will be exposed to both moisture and heat.

The binding agent is selected from a group of known binding agents to ensure that the scented material is mostly released as the product packaging is being handled in the hands of a consumer, and not prematurely, or not at all. In this manner, when the package is being handled, touched when sampling, or opened, eaten or drunk from when consuming or using, the scented material can be perceived as product is handled and/or consumed from the packaging.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention system and method can be applied to many different types of products and packages, the present invention is best (i) when applied to products that are typically handled or consumed directly out of their packaging to release aroma to improve the consumer experience; and (ii) when applied to packaging for consumables and non-consumables to convey product aroma from the package at the point of sale for sampling purposes. The exemplary embodiments show the present invention applied to a variety of applications. These embodiments are selected in order to set forth the best modes contemplated for the invention. The illustrated embodiments, however, are merely exemplary and should not be considered a limitation when interpreting the scope of the appended claims.

Figure 1:
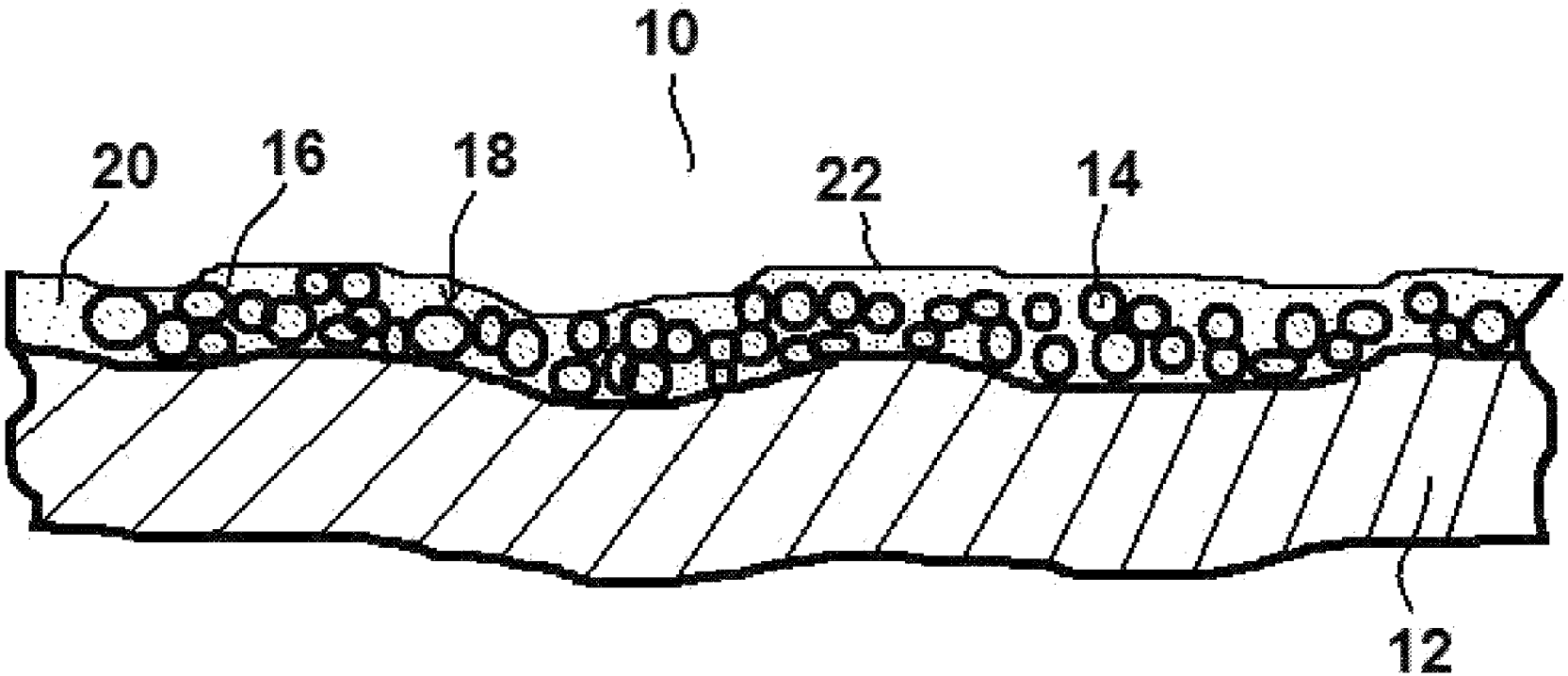
FIG. 1 is an fragmented cross-sectional view of a portion of scented microencapsulate coating on a segment of product packaging.

Referring to FIG. 1, a cross-section of a layer of scented microencapsulate coating 10 is shown applied to a section of product packaging 12. As will be later explained in more detail, the scented microencapsulate coating 10 contains scented oils or other scented compounds 14 that are encapsulated in a duty-specific encapsulant 16 to produce encapsulated particles 18. The encapsulated particles 18 are then mixed with a duty-specific adhesive or binding agent 20 to create an emulsion 22. The emulsion 22 is then sprayed, printed, painted, dipped or otherwise applied to the exterior surface 24 of the product packaging 12. The emulsion 22 is then cured to produce the scented microencapsulate coating 10. As will be later explained, the scented microencapsulate coating 10 can be applied in various thicknesses and with different sized encapsulated particles 18 to achieve different results.

As has been mentioned, both the encapsulant 16 and the binding agent 20 are duty-specific depending upon the product to which the scented microencapsulate coating 10 is applied. The duty variables include: type-1) likely to be exposed to moisture before use; type-2) likely to be exposed to moisture at use; type 3) likely to be exposed to heat, type 4) likely to be exposed to moisture and heat. The compositions for these three types of scented microencapsulate coating are be explained below.

The type-1 duty specific application is "likely to be exposed to moisture." This application applies to products such as beer bottles, that are likely to experience surface condensation after being stored in a refrigerated environment. In other words, the exterior surface of the container is likely to be exposed to moisture or water. In such an application, the scented microencapsulate coating 10 should not be made to be highly water-soluble. If it were, the scented microencapsulate coating 10 would come off the package when exposed to water or condensation. Accordingly, for containers that will be exposed to moisture, the scented microencapsulate coating 10 is made to be generally hydrophobic, offering both adhesion to the substrate and protection against pre-mature rupture, yet physically vulnerable when handled as intended. In such a duty cycle, it is required that the scented microencapsulate coating 10 be resistant to being washed away, yet allow the scented microencapsulate coating 10 to be ruptured when touched so that it easily releases the desired aroma.

In order to create these physical characteristics, the encapsulant 16 used to encapsulate the scented compounds 14 can be made to be at least partially water soluble. However, the binding agent 20 can be made to be hydrophobic. Accordingly, the binding agent 20 will help protect the encapsulant 16 from moisture. However, what moisture that does pass through the binding agent 20 will soften the encapsulated particles 18. Accordingly, the binding agent 20 will not be firmly supported. As a consequence, anyone who touches the scented microencapsulate coating 10 is likely to physically break the binding agent 20 and the encapsulated particles 18 to release the scented compounds 14 resulting in an aromatic experience for the consumer.

Encapsulants that are at least partially water soluble are well known. Such encapsulants include, but are not limited to, gelatin, glycerol, cellulose and starch-based polymers. Likewise, hydrophobic binding agents are well known and include styrene acrylic emulsions and ethylene acrylic copolymers.

The type-2 duty specific application is "likely to be exposed to moisture at use." This application applied to flexible packaging such as snack bags and trash bags. Accordingly, condensation is not a concern. In the application of a snack bag, it can be assumed that the exterior of the packaging will be grasped by a user's hands. A human's hands are typically very moist. This is because skin constantly releases water and sweat to keep the dermis layer of the skin hydrated. The amount of moisture is small, however it is nearly always present. In the case of trash bag, it can be assumed that the interior of the trash bag will be exposed to the moisture of refuse that is deposited into the trash bag.

In such a duty specific application, the scented microencapsulate coating 10 can be made with both a water soluble encapsulant 16 and a water soluble binding agent 20. In this manner, whenever a person touches exterior of product packaging 12, or garbage touches the interior of the product packaging 12, the small amount of moisture on the skin or garbage will dissolve and/or weaken an even smaller amount scented microencapsulate coating 10. The force of the physical contact will then cause ruptures or enlarge ruptures in the encapsulated particles 18 to release the scented compounds 14. As a consequence, aroma is released every time the product packaging 12 is manipulated.

As previously mentioned, water soluble encapsulants can include gelatin, glycerol, cellulose and starch-base polymers. Water soluble binding agents can include starch-based polymers, polyvinyl acetates and polyvinyl alcohols. Starch-based polymers include hygroscopic plastarch material PSM. Several formulations of such PSM materials are commercially available in the marketplace. One such composition of a preferred type of PSM is described in U.S. Patent Application Publication No. 2008/0153958 to Ding, entitled Substantially Completely Biodegradable High Starch Polymer, the disclosure of which is incorporated into this specification by reference.

The type 3 duty specification application is intended to be exposed to heat. This applies to microwavable or ovenable trays in which prepared foods are cooked at home. Due to the fact the foods were frozen and in some cases cook very rapidly, little aroma is released from the product. In this case, the heat of a microwave oven or conventional oven is intended to break down the wall of the microcapsule and release the intended aroma in the cavity of the oven.

The type-4 duty specific application is "likely to be exposed to moisture and heat." This application applies to coffee cups, coffee cup lids, and the like. In such applications, it can be assumed that the exterior of the packaging will be heated to a temperature above ambient temperature when being used.

Since microwavable and ovenable containers contain foods with a moisture content, they are exposed to both moisture and heat during cooking and consumption. In such a duty application, both the encapsulant and the binding agent can be made from soluble materials that are temperature sensitive. There are temperature sensitive biostarch polymers that can be used both as encapsulants and as binding agents. Such films can be made to be dissolvable at temperatures over 110 degrees Fahrenheit. Such materials are commercially produced by Biostarch Technology Pte. Ltd of Singapore and are sold under the trade name Biostarch®. By making the scented microencapsulate coating 10 from such materials, it will be understood that the scented microencapsulate coating 10 will only release the scented compounds 14 when both exposed to moisture and exposed to an elevated temperature.

Figure 2:
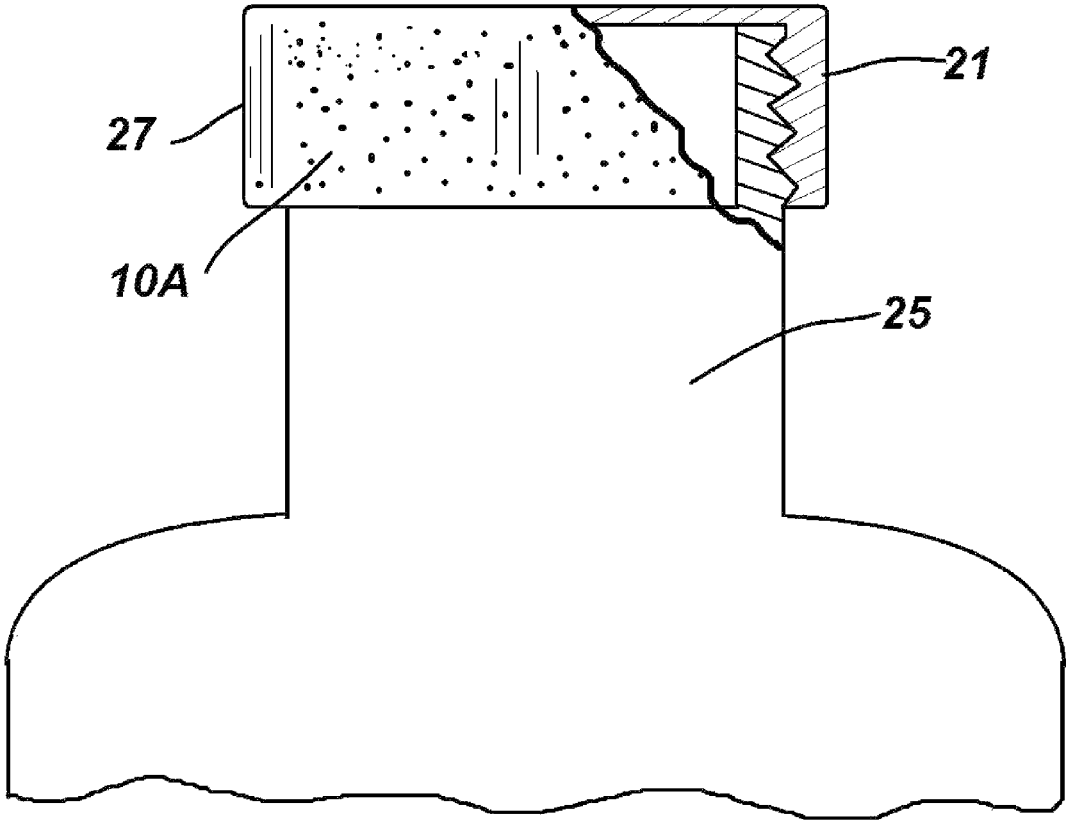
FIG. 2 is a fragmented view of the top end and closure of a bottle container having a scented microencapsulate coating.

Referring to FIG. 2, a closure 21 of a bottle container 25 is shown. The closure 21 is made molded of plastic and has internal threads 23 that engage the bottle container 25. The closure 21 has external surfaces 27 that are engaged by a user when the closure 21 is manually twisted off of the bottle container 25.

The external surfaces 27 are covered by the scented microencapsulate coating 10A. Consequently, when people handle the closure 21 the scented microencapsulate coating 10A is ruptured, releasing the intended aroma.

Figure 3:
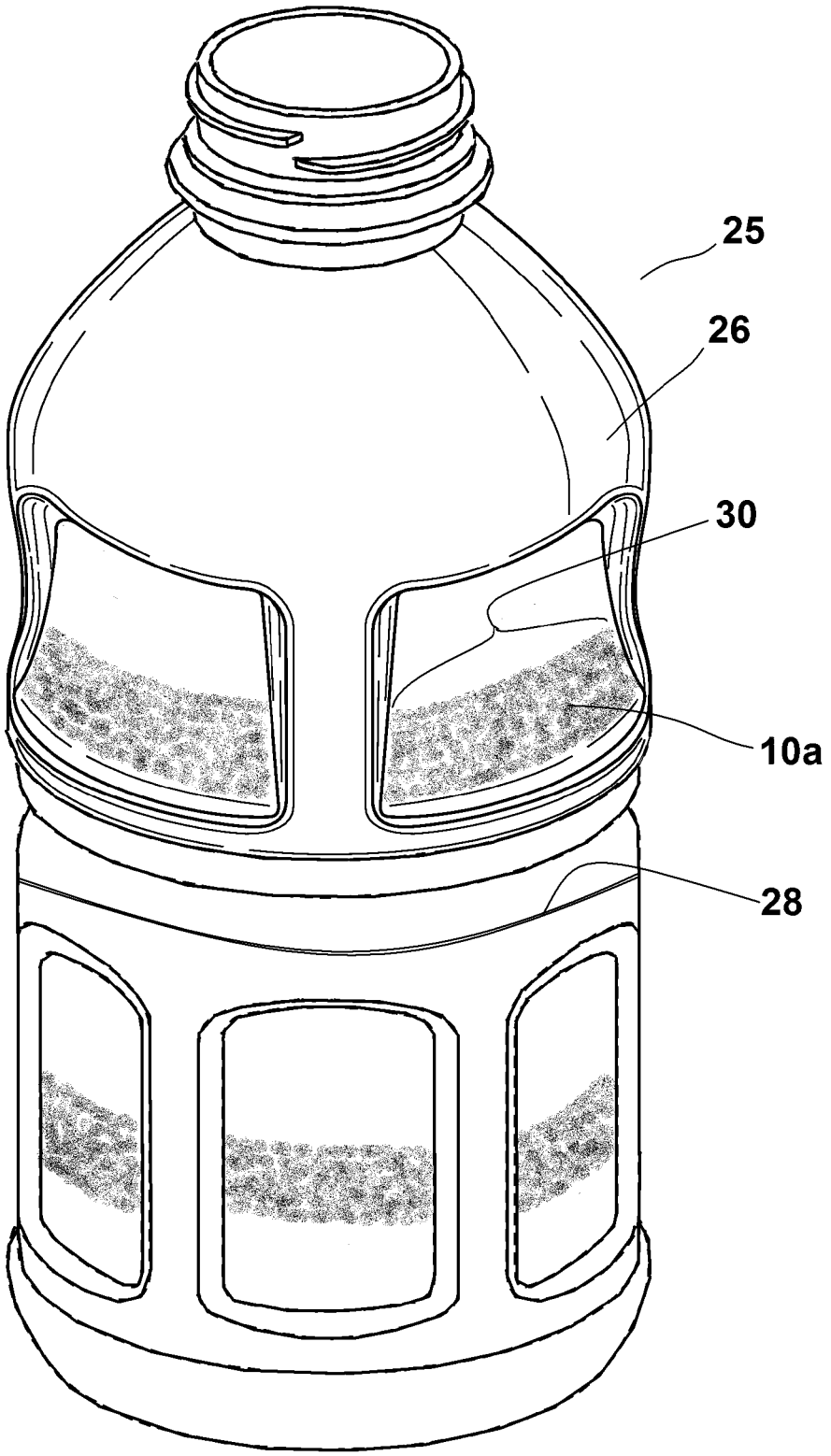
FIG. 3 is a front view of a bottle closure on a bottle that has a microencapsulated coating.

In FIG. 2, the closure 21 is covered in the scented microencapsulate coating 10A. However, depending upon the shape of the bottle container 25, other areas are likely to be handles and can also be coated. Referring to FIG. 3, the bottle container 25 is shown as the product packaging. The bottle container 25 has an external surface 26 upon which labeling 28 is either adhered or printed. An application area 30 on the external surface 26 is covered with a scented microencapsulate coating 10A. The application area 30 covered by the scented microencapsulate coating 10A may or may not correspond with the labeling 28. The primary importance in this embodiment is that the application area 30 of the bottle container 25 covered with the scented microencapsulate coating 10 corresponds with the regions of the bottle container 25 that are likely to be grasped by a person holding the bottle container 25.

Figure 4:
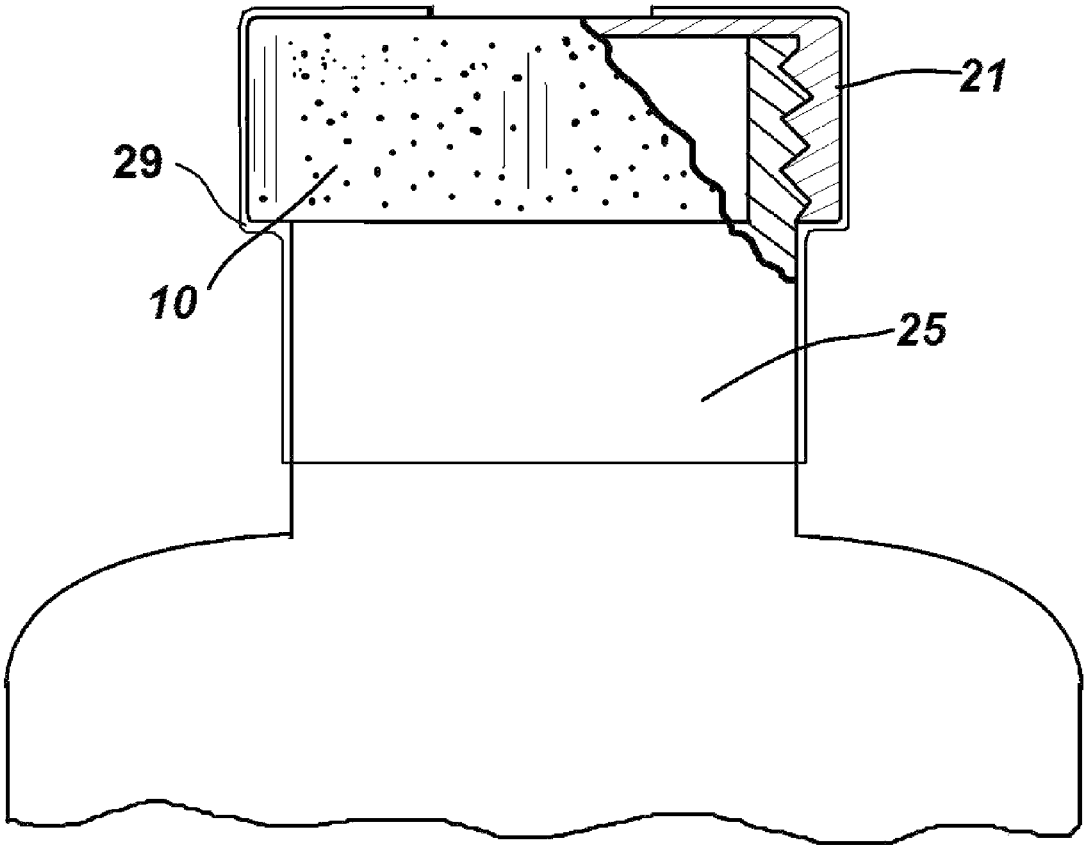
FIG. 4 is a fragmented view of the top end and closure of a bottle container having a scented microencapsulate coating and being covered in shrink wrap material.

In some cases, a manufacturer may not want consumers to be able to sample scent in advance and may only want to have the scented microencapsulate coating be activated just during opening. This can be accomplished by applying the microencapsulate and then using a shrink band seal. Referring to FIG. 4, the closure 21 of a bottle container 25 previously described is now shown with a shrink band seal 29. The shrink band seal 29 protects the scented microencapsulate coating 10 from inadvertent contact prior to purchase. However, after purchase, the shrink band material is removed. The very act of removing the shrink band material would disrupt the scented microencapsulate coating 10 and release the intended aroma.

To increase the disruption of the scented microencapsulate coating 10, the system would utilize a different formulation of microencapsulate and binder. The microencapsulate binder emulsion is applied wet, and while still wet, the shrink band is then applied. The heat used to shrink the band seal 29 can also be used to cure the scented microencapsulate coating 10A. This will cause the scented microencapsulate coating 10A to bond to both the underlying closure and the shrink band seal 29. Consequently, when the shrink band seal 29 is removed, it completely disrupts the scented microencapsulate coating 10, releasing the desired scent.

For the embodiments of FIGS. 2, 3 and 4, it can be assumed that the bottle container 25 is a sports drink bottle. Accordingly, a type-1 scented microencapsulate coating 10A is preferably used. This is because such containers are likely to experience surface condensation or even being stored in iced water. In other words, the exterior surfaces of the bottle container 25 are likely to be exposed to significant amounts of water. The scented microencapsulate coating 10A can be applied either in a thin layer as to be invisible or thickly to the bottle container 25. In regards to the thicker treatment, this will supply the bottle container 25 with a textured exterior that can make the bottle container 25 easier to hold when wet. It may even be designed to make the bottle look wet when it is actually dry. The textured surface will also entice people to grasp or touch the textured surface when manipulating the bottle container 25.

Since the scented microencapsulate coating 10A will be contacted when the bottle container 25 is being used, some of the binding agent and encapsulant will wear away with the physical contact. This will release the scented compounds around the bottle container 25 that can be perceived when the bottle container 25 is brought close to the face. The scented compounds 14 can have any aroma that is consistent with the expected aroma of the beverage being consumed from the bottle container 25. For example, if the beverage is a sports drink, the scented material can have the aroma of lime, vanilla, cherry, cola or anything else that matches the anticipated aroma. This positive aroma experience supersedes any negative aroma perception caused by processing or stale gases trapped in the headspace of the bottle container 25. Additionally, for non mainstream flavors such as Goji, Acia, Mangosteen and others, the encapsulated aroma can be a way to allow consumers to sample the new flavor aromatically, prior to purchase.

When the beverage is handled and opened, the user will smell the improved aroma and be predisposed to like the beverage better. The perceived scent can also positively alter the user's anticipation of the taste. This positive scent experience supersedes any negative scent perception caused by stale gases trapped in the headspace of the bottle container which are released during opening.

Figure 5:
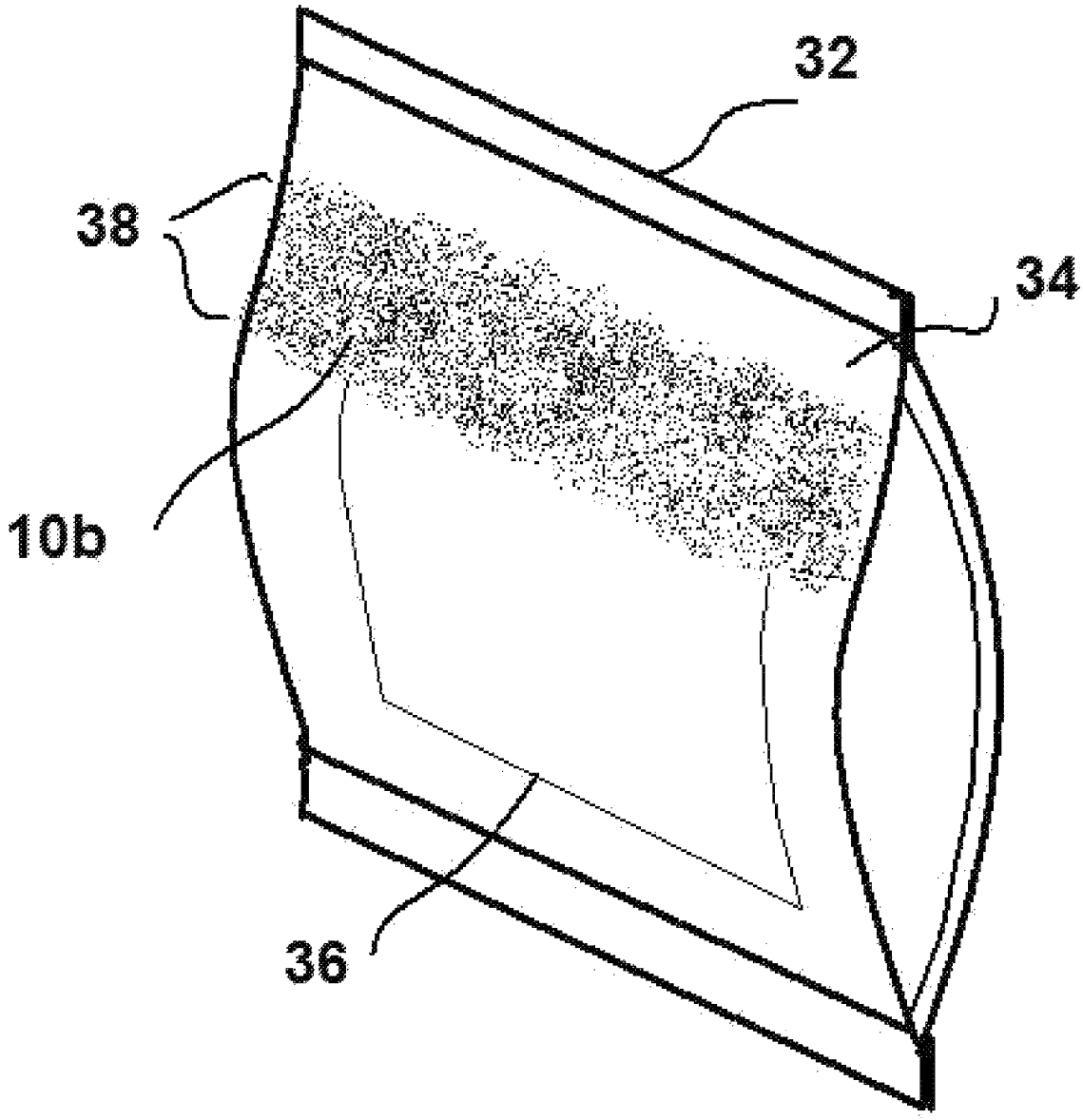
FIG. 5 is front view of bag packaging having a scented microencapsulate coating.

Referring to FIG. 5, a flexible bag 32 is now shown. The flexible bag 32 has an external surface 34 upon which labeling 36 is typically printed. An application area 38 exists on the external surface 34 that is covered in a scented microencapsulate coating 10B. The application area 38 covered by the scented microencapsulate coating 10B may or may not correspond with the labeling 36. What is of primary importance in this embodiment is that the application area 38 of the flexible bag 32 corresponds with the regions of the flexible bag 32 that are likely to be grasped by a person holding the flexible bag 32.

Assuming that the flexible bag 32 is a chip bag or similar snack bag, it will be understood that a type-2 scented microencapsulate coating 10B is used. This is because such flexible bags 32 are not likely to be exposed to water other than to the moisture of a user's hands. In other words, the exterior surface 34 of the flexible bag 32 is not likely to be exposed to significant amounts of moisture. The scented microencapsulate coating 10B can be applied either very thinly as to be invisible, or thickly to the flexible bag 32. It can be applied to the outside where the flexible bag 32 is handled, or inside so that as people reach in, their hand would rub up against the microcapsules and rupture them, releasing scent. In the event of the thicker option, this will supply the flexible bag 32 with a textured exterior that can make the flexible bag 32 easier to hold. The textured surface will also entice people to grasp the textured surface when manipulating the bag container 32. The scented microencapsulate coating can be applied so thickly, that it reinforces the structural integrity of the flexible bag 32 and prevents the flexible bag 32 from tearing in unusual directions when the bag container is pulled open.

Since the scented microencapsulate coating 10B will be contacted when the flexible bag 32 is being used, some of the binding agent and encapsulant will wear away with the physical contact. This will release the scented material in or around the flexible bag 32 that can be perceived when the bag container 32 is brought close to the face. The aroma of the scented material can be any aroma that compliments the flavor of the product being consumed from the flexible bag 32. For example, if the bag container 32 holds chips, the scent can be of lime, jalapeno, barbeque, or anything else that complements or conveys the true aroma and/or flavor. When the contents of the bag or container are consumed, the user will taste and smell the product. The user will also smell the scented material. The perceived scent will positively alter the user's perception of the product. This positive scent experience supersedes any negative scent perception caused by stale gases trapped in the headspace of the flexible bag 32.

Figure 6:
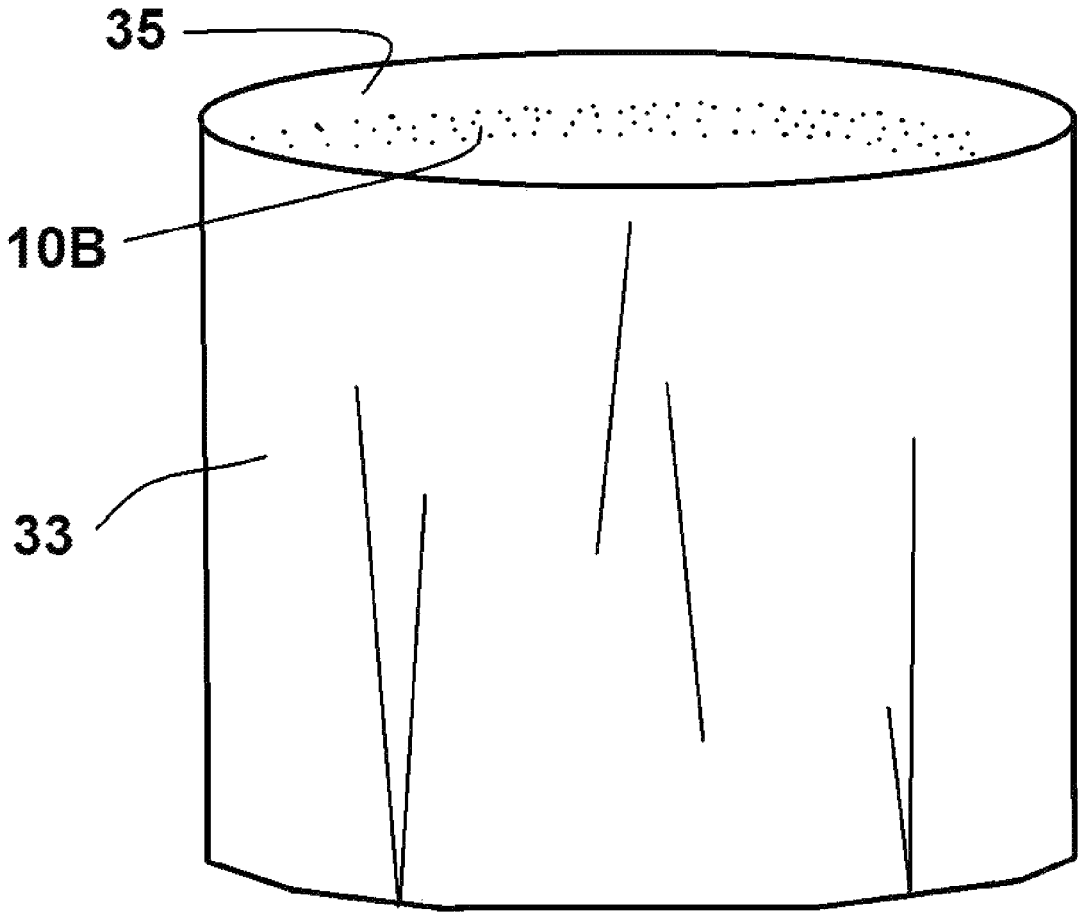
FIG. 6 is front view of a garbage bag having a scented microencapsulate coating.

Referring to FIG. 6, a garbage bag 33 is shown. The garbage bag 33 has the scented microencapsulate coating 10B coating at least a portion of an interior surface 35. In this manner, when garbage is tossed into the garbage bag 33, the contact from the garbage disrupts the scented microencapsulate coating 10B and releases scent. Furthermore, the moisture from the garbage can dissolve and/or soften the scented microencapsulate coating 10B to release even more scent.

In this manner, when the garbage bag 33 is opened, a person smells the released scent rather than the smell of the garbage contained in the bag 33.

Figure 7:
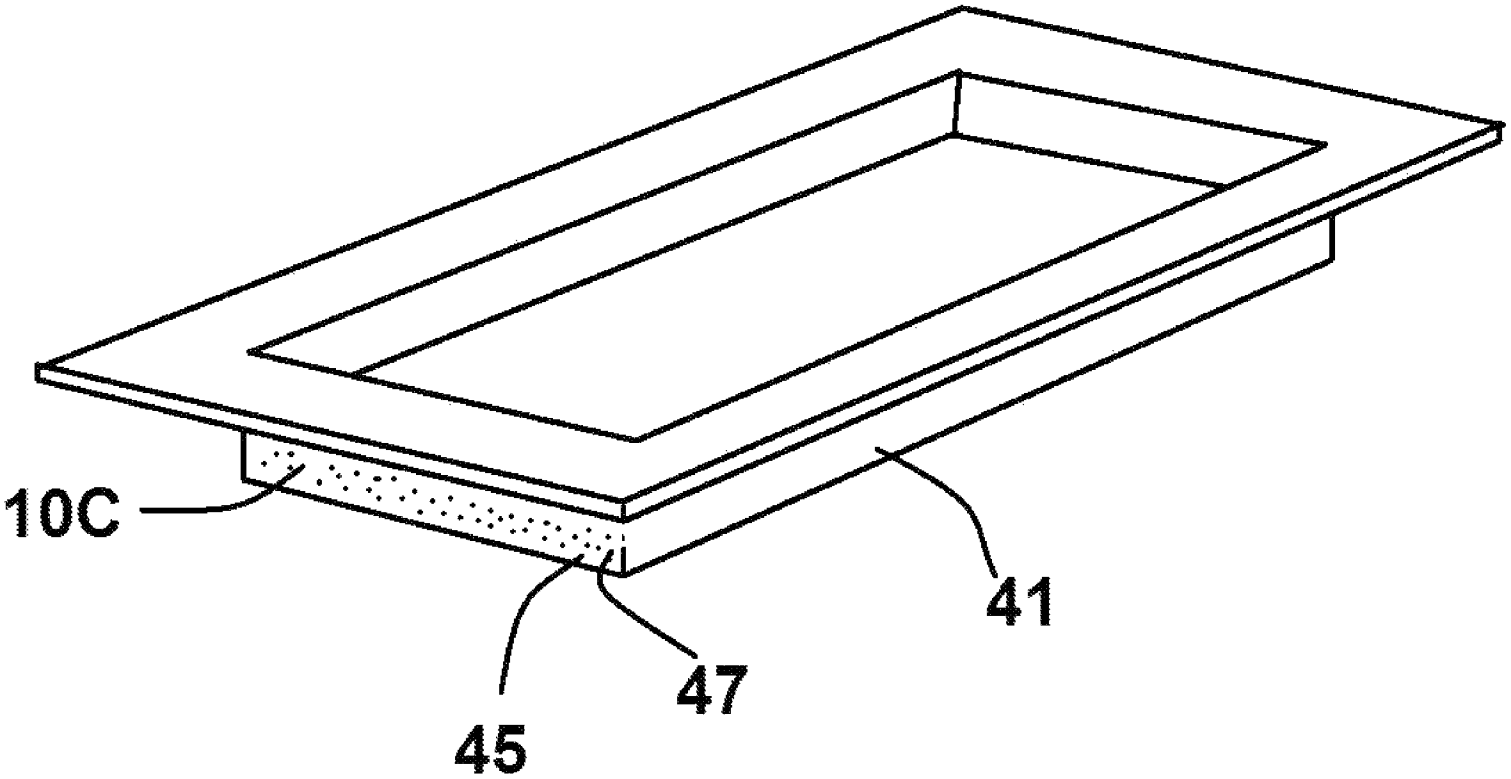
FIG. 7 is front view of a microwave tray having a scented microencapsulate coating.

Referring to FIG. 7, a microwave tray 41 is shown that holds a prepared portion of food 43. An application area 45 exists on the external surface 47 that is covered in a scented microencapsulate coating 10C. Assuming that the microwave tray 41 will be placed in a microwave oven and will heat as the food 43 heats, it will be understood that a type-3 scented microencapsulate coating 10C is used. This is because such the type-3 scented microencapsulate coating 10C breaks down and releases scent as it is heated. In this manner, when a person opens the microwave door, they are presented with a strong pleasant scent that need not originate from the actual food 43.

Figure 8:
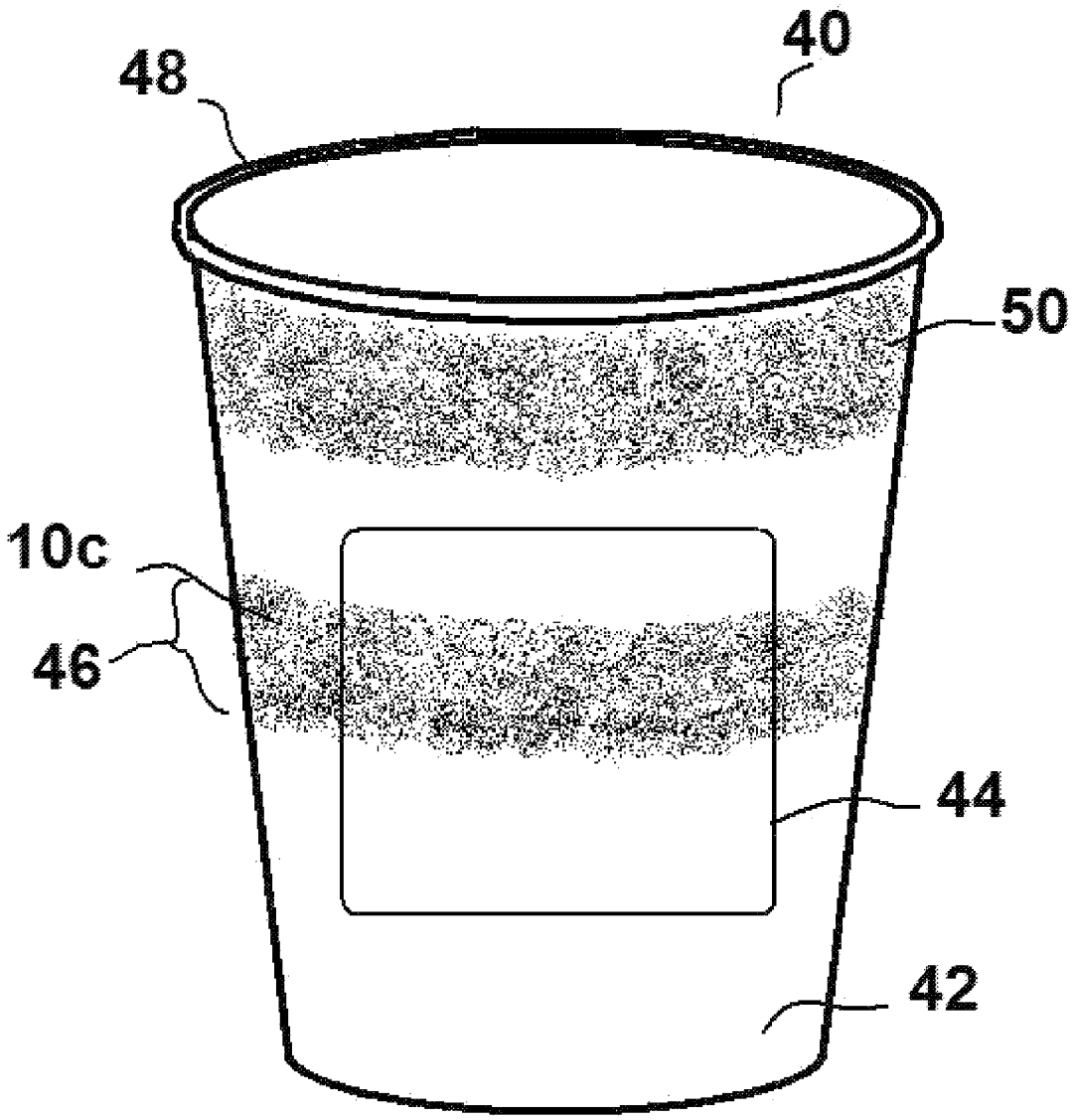
FIG. 8 is front view of a cup container having a scented microencapsulate coating.

Referring to FIG. 8, a cup container 40 is shown. The cup container 40 has an external surface 42 upon which labeling 44 is typically printed. An application area 46 exists on the external surface 42 that is covered in a scented microencapsulate coating 10D. The application area 46 covered by the scented microencapsulate coating 10D may or may not correspond with the labeling 44. Assuming that the cup container 40 is a coffee cup, it will be understood that a type-4 scented microencapsulate coating 10D is used. This is because such a cup container 40 will be exposed to both moisture and heat. In the event the cup is for yogurt cup or ice cream, then type 1 would be used. The scented microencapsulate coating 10C can be applied thinly as to be invisible, or thickly to the cup container 40. Utilizing a thick coating will supply the cup container 40 with a textured exterior that can make the cup container 40 easier to hold or which invites consumers, thus releasing scent. The textured surface will also entice people to touch or grasp the textured area allowing them an additional sensorial experience of feel the product's surface when holding the cup container 40.

Since the scented microencapsulate coating 10D will be contacted when the cup container 40 is being used, some of the binding agent and encapsulant will be activated by the physical contact. The wear is increased by the dissolving action caused by the moisture and heat. This will release a small amount of scented material around the cup container 40 that can be perceived when the cup container 40 is brought close to the face. Furthermore, it is highly likely that a person will drink from the brim 48 of the cup container 40. This will expose an area 50, proximate the brim 48, to the direct moisture and heat of the user's mouth. The moisture, heat, and physical contact will release the scented material in the area of contact.

The scented material can have any aroma that compliments the flavor of the beverage or product being consumed. For example, if the cup container 40 holds coffee, the scent can be of cinnamon, coco, vanilla, and anything else that compliments the true coffee flavor. When the coffee is consumed, the user will have an enhanced taste and smell experience. It may also be preferable to add a sweet, sour, minty, or other sensation to the brim which will deliver a mouth feel and enhance the drinker's experience. Further, it may also be used to reduce the amount of sugar used in sweetened beverages as the sweet experience is delivered directly to the tongue. The user will also smell the scented material. The perceived scent will alter the user's perception of the taste. This positive scent experience supersedes any negative scent perception caused by the synthetic material of the cup container 40.

It has be repeatedly stated that the scented microencapsulate coating can be applied very thickly to a products packaging. This can add texturing to product packing, a cup, bowl, or similar item. The scented microencapsulate coating can be applied so thickly, that the microencapsulate coating itself can form a safety seal on the product packaging.

Figure 9:
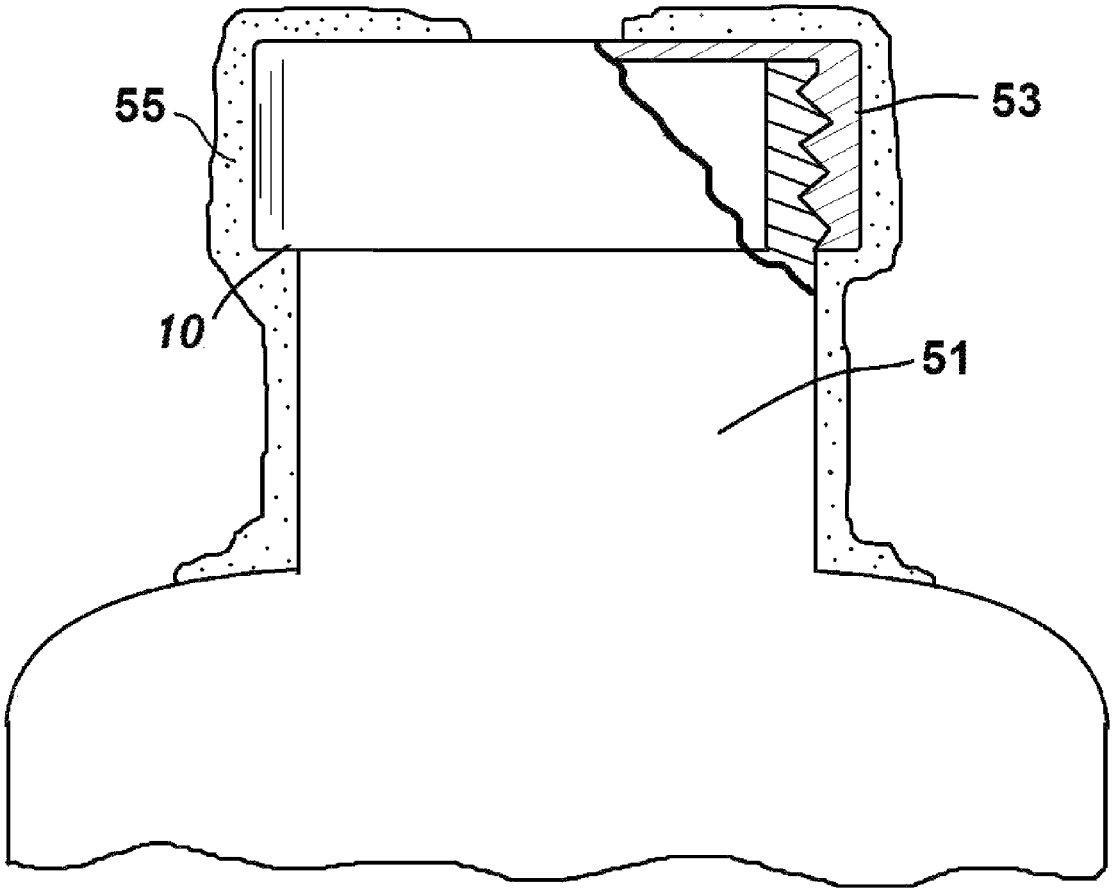
FIG. 9 is a fragmented view of the top end and closure of a bottle container seal by a thick application of a scented microencapsulate coating.

Referring now to FIG. 9, a bottle container 51 and closure 53 are shown. The closure 53 is covered a thick peel-away seal 55. The peel-away seal is made from built-up layers of the scented microencapsulate coating 10.

In order to open the bottle container 51, the peel-away seal is broken and pulled off the bottle container 51 and closure 53. This breaks apart the scented microencapsulate coating 10 and releases aroma.

Figure 10:
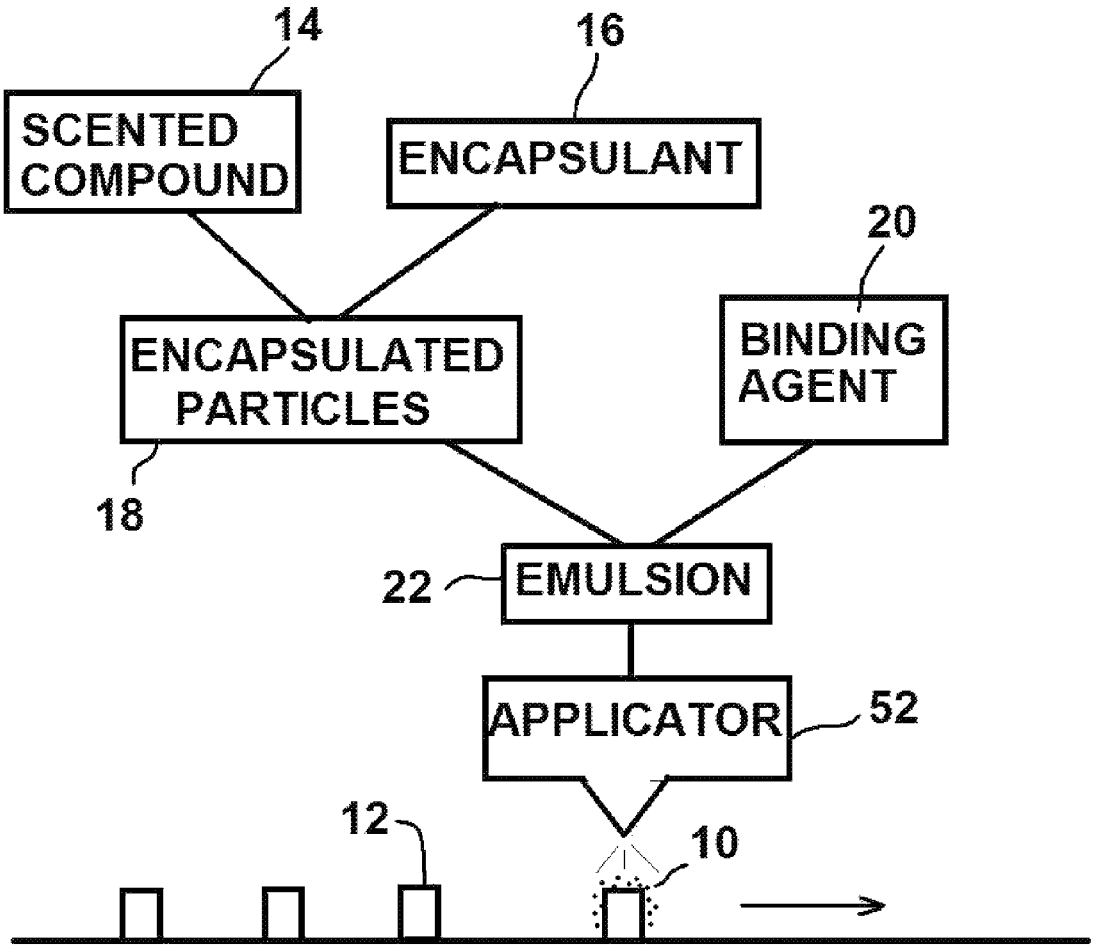
FIG. 10 is a block diagram schematic illustration a method of applying a scented microencapsulate coating to product packaging.

Referring to FIG. 10 in conjunction with FIG. 1, a methodology of applying the scented microencapsulate coating 10 to product packaging 12 is shown. The methodology is applicable to type-1, type-2, type-3 and type-4 scented microencapsulate coatings 10. A selected volume of scented compounds 14 are encapsulated in an encapsulant 16 to create encapsulated particles 18. The encapsulated particles 18 are then mixed with a selected binding agent 20 to form an emulsion 22. The characteristics of the binding agent 20 depend upon whether a type-1, type-2, type-3 or type-4 scented microencapsulate coating 10 is to be created as well as the type of packaging substrate being used. For example, different plastics have different surface tensions which require the use of specific materials to enable proper adhesion and performance.

The emulsion 22 is then applied to a products packaging 12 using an applicator 52. The applicator 52 can be a single or multiple spray heads, an air pressure applicator, a printing head, a dip tank, or a brush applicator. Once the emulsion 22 has been applied, it is cured to form the scented microencapsulate coating 10 in the selected areas of the product packaging 12. Due to the nature of the scented microencapsulate coating 10, it is preferred that the scented microencapsulate coating 10 not be cured with high heat. Rather, air drying with or without light heat, or curing using UV radiation is preferred to prevent and premature release of scented compounds 14.

The illustrated containers are merely exemplary of the many types of containers that are used to hold consumable products. It will therefore be understood that the embodiments of the present invention described and illustrated herein are merely exemplary and a person skilled in the art can make many variations to the embodiments shown without departing from the scope of the present invention. All such variations, modifications, and alternate embodiments are intended to be included within the scope of the present invention as defined by the appended claims.

What is claimed is:

1. A method of adding a scented microencapsulate coating to the exterior of a beverage container, said method comprising the steps of:

encapsulating scented compounds in an encapsulant to create encapsulated particles;

mixing said encapsulated particles with a binding agent, to create an emulsion, wherein said binding agent is hydrophobic;

providing a beverage container that has a closure that is typically touched or handled by a person during removal or use of a product from within said beverage container;

applying said emulsion to said closure to form a scented microencapsulate coating on said closure;

applying a shrink band seal over the closure and said scented microencapsulate coating; and exposing said closure and said shrink band seal to heat to both cure said scented microencapsulate coating and shrinking said shrink band seal, wherein said scented microencapsulate coating bonds to both said closure and said shrink band seal, wherein said scented microencapsulate coating ruptures when said shrink band seal is manually removed from said closure.

2. The method according to claim 1, wherein said encapsulant is water soluble.

3. The method according to claim 1, wherein said encapsulant is selected from the group consisting of gelatin, glycerol, melamine, urea formaldehyde, cellulose, and starch-based polymers.

4. The method according to claim 1, wherein said binding agent is selected from the group consisting of styrene acrylic emulsions, acrylate monomers, oligimer esters, and ethylene acrylic copolymers.

5. A method of producing a packaging container with areas that release scent when touched, said method comprising the steps of:

providing a product packing having an exterior surface, wherein said product packaging is a beverage container having a closure;

providing a scented microencapsulate coating that contains a scented compound enveloped in an encapsulant and bound into said scented microencapsulate coating with a binding agent, wherein said binding agent is hydrophobic;

applying said scented microencapsulate coating to areas of said closure, wherein said scented microencapsulate coating contains said scented compounds bound within said encapsulate;

applying a shrink band seal over the closure and said scented microencapsulate coating; and exposing said closure and said shrink band seal to heat to both cure said scented microencapsulate coating and shrinking said shrink band seal, wherein said scented microencapsulate coating bonds to both said closure and said shrink band seal, wherein said scented microencapsulate coating ruptures when said shrink band seal is manually removed from said closure.

6. The method according to claim 5, wherein said encapsulant is water soluble.

7. The method according to claim 6, wherein said encapsulant is selected from the group consisting of gelatin, glycerol, cellulose and starch-based polymers.

8. The method according to claim 5, wherein said binding agent is selected from the group consisting of styrene acrylic emulsions and ethylene acrylic copolymers.

* * * * *